US008610534B2

(12) United States Patent
Rinner et al.

(10) Patent No.: US 8,610,534 B2
(45) Date of Patent: Dec. 17, 2013

(54) COMPONENT

(71) Applicant: Epcos AG, Munich (DE)

(72) Inventors: Franz Rinner, Deutschlandsberg (AT); Christoph Auer, Graz (AT); Shaoyu Sun, Zhuhai Guangdong (CN); Yihai Sun, Zhihai Guangdong (CN)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 13/690,050

(22) Filed: Nov. 30, 2012

(65) Prior Publication Data

US 2013/0141208 A1 Jun. 6, 2013

(30) Foreign Application Priority Data

Dec. 1, 2011 (CN) ..... 2011 2 0578752 U

(51) Int. Cl.
*H01C 7/10* (2006.01)

(52) U.S. Cl.
USPC ..... 338/21; 338/323; 338/329

(58) Field of Classification Search
USPC ..... 338/21, 323, 329, 307, 330
See application file for complete search history.

(56) References Cited

U.S. PATENT DOCUMENTS

| | | | | |
|---|---|---|---|---|
| 7,053,749 | B2 * | 5/2006 | Ishida et al. | 338/324 |
| 7,148,785 | B2 * | 12/2006 | Becker et al. | 338/22 R |
| 2002/0175801 | A1 * | 11/2002 | Katsuki et al. | 338/22 R |

* cited by examiner

*Primary Examiner* — Kyung Lee
(74) *Attorney, Agent, or Firm* — Slater & Matsil, L.L.P.

(57) ABSTRACT

A component includes a component body and a contact-connection element composed of sheet metal having a contact region, which has an outer contour line and at least one hole. The contact region is arranged on a side of the component body having a side edge and the outer contour line has straight regions running along straight regions of the side edge. The straight regions of the outer contour line are connected by rounded corners.

14 Claims, 2 Drawing Sheets

COMPONENT

This application claims priority to Chinese Patent Application 201120578752.8, which was filed Dec. 1, 2011, and is incorporated herein by reference.

TECHNICAL FIELD

The invention relates to a component comprising a component body and a contact-connection element.

BACKGROUND

Some components, for example ceramic varistors for protecting electrical networks and installations against overvoltage and overcurrent, require contact-connection elements for external contact-connection which afford a high current-carrying capacity. For this purpose, an outer metallisation in the form of a thin metallic layer (e.g., silver) can be applied with a homogeneous thickness on the component body, for example a ceramic varistor. For external contact-connection, via which the supply of the component body is effected, for example contact metal sheets (e.g., composed of sheet copper) are soldered onto the metallized areas of the component body, such that they completely or partly cover the metallized areas.

There are various geometry variants for the contact-connection elements for external contact-connection which pursue the approach that the connection metal sheet for external contact-connection covers the metallized areas approximately over the whole area. A disadvantage is that large contact areas bring about high thermomechanical stresses after the connection metal sheet has been soldered on, which potentially lead to cracking in the ceramic body and as a further consequence potentially to the failure of the component. Further disadvantages are that the soldering quality is difficult to evaluate and some specification or customer requirements can be difficult to implement with metal sheets soldered on approximately over the whole area.

Another approach involves rings or strips being soldered on, which partly cover the metallization areas, but the form of which is not optimal with regard to the current-carrying capacity. Here the disadvantages are inhomogeneous current density distributions bring about local excessive temperature increases in the metallization layer. As a result, either the current-carrying capacity of the component decreases or it is necessary to use thick metallization layers, which increase use of material and costs.

SUMMARY OF THE INVENTION

The problem addressed by the invention is that of providing a component comprising a contact-connection element for the external contact-connection of a block-shaped component body, for example of a varistor, which enables a high current-carrying capacity and a high robustness with respect to thermomechanical loadings with the least possible use of material. Compliance with, for example customer-specific, stipulations with regard to form and position of the further contact-connection is also desirable.

The solution is a component comprising a component body and a contact-connection element composed of sheet metal comprising a contact region, which has an outer contour line and at least one hole, wherein the contact region is arranged on a side of the component body comprising a side edge and the outer contour line has straight regions running along straight regions of the side edge, wherein the straight regions of the outer contour line are connected by rounded corners. Running along means substantially running alongside one another or running one on top of another.

The high current-carrying capacity of the contact-connection element with at the same time little use of material is achieved by the specific shaping of the sheet-metal contact-connection element. A contact region thereof is soldered onto a metal layer of the component body, for example of a varistor, and partly covers the metallization layer. The proposed form of the contact-connection element is optimised for component bodies, e.g., varistors, having an angular, for example rectangular or square, cross section.

Features of the contact region geometry for a rectangular or square component body are the outer contour line is rectangular or square with rounded corners. In the center of the sheet-metal contact region there is a circular hole, which is partly filled with sheet-metal material by a straight web, such that for example two circle-segment-shaped holes are present. A plurality of webs are also conceivable. By virtue of the specific form of the contact region or connection metal sheet, the current is distributed very homogeneously in the metallization layer of the component, e.g., varistor. Thus, local excessive current density and temperature increases are avoided and a high current-carrying capacity is achieved.

The sheet-metal form proposed is suitable both for further contact-connections comprising a laterally fitted lug and for further contact-connections via an elevated area in the central region of the component. This makes it possible to take account of specification requirements concerning position and form of the further contact-connection.

The sheet-metal forms of the exemplary embodiments of the contact-connection element can be produced technically simply and cost-effectively (e.g., by stamping) and can be soldered onto the metallization layers of components, e.g., varistors, by standard methods.

The form of the contact-connection element prevents current density fluctuations, such that the metal layer or metallization layer on the component body can be made thin and in material-saving fashion. The contact region is also made in material-saving fashion. This is made possible by the specific shaping of the connection metal sheet, which fulfils the above-described requirements with the smallest possible covered area on the component body. This makes it possible, in particular, to match the loading of the metallization layer within and outside the soldered region. This is achieved by the combination of a circular inner contour of the holes and a rounded, square outer contour of the contact region. The additional web-shaped region between the holes provides, in the inner region of the contact region, for homogeneous current distribution with further contact-connection on one side and a small thickness of the metal sheet (e.g., 0.3 mm). Moreover, the web-shaped region makes it possible to arrange further contact-connections in the central region of the component cross section (e.g., by means of an elevated sheet-metal region on the web-shaped region without local excessive current density increases).

BRIEF DESCRIPTION OF THE DRAWINGS

The invention is explained below on the basis of exemplary embodiments with reference to the drawings, in which.

Identical reference signs designate identical features or ones having similar functionality.

DETAILED DESCRIPTION OF ILLUSTRATIVE EMBODIMENTS

Figure 1:
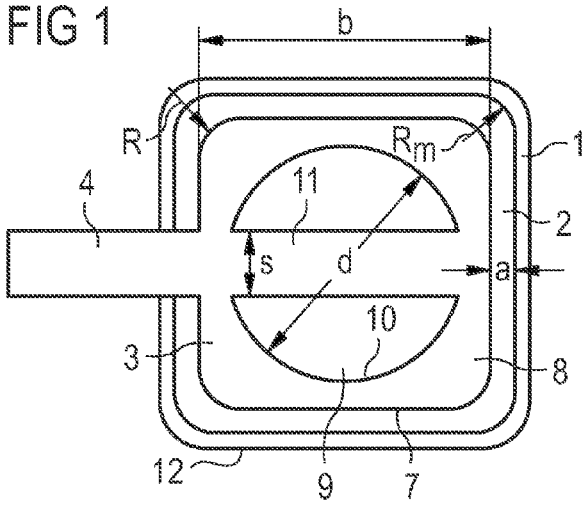
FIG. 1 shows the front side of an exemplary embodiment of a component.

FIG. 1 shows the front side of an exemplary embodiment of a component, for example of a varistor. The component comprises as component body 1 a ceramic block, which can have the exemplary dimensions 33×33×3 mm with a rounding having a radius of 4 mm. A metal layer 2, for example a silver layer, having the size of 30×30 mm with a rounding having a radius of 4 mm is in each case applied to the front and rear sides of the component body 1.

The external contact-connection is effected via a contact-connection element 3 composed of sheet metal, for example copper, comprising a contact region 8, which is applied, e.g., soldered, on the metal layer 2 and covers the latter in regions. The contact-connection element 3 furthermore comprises a further contact-connection 4, which abuts the contact region 8 centrally as a 6 mm wide strip on the front side, for example. The further contact-connection 4 is web- or lug-shaped and extends away from the component body 1. At the end of the further contact-connection 4, a hole can be provided or the end can be bent over (not shown in FIG. 1). Between the transition of contact region 8 and further contact-connection 4, a stepped offset can be provided, for example formed by two bends having the same angle, but in opposite directions.

The contact region 8 extends as far as the side edge 12 of the component body 1, more precisely as far as the edge of the metal layer 2. However, a distance a is provided between the side edge 12 of the component body 1 or the metal layer 2 and an outer contour line 7 of the contact region 8. The outer contour line 7 has straight regions running along straight regions of the side edge 12 of the component body 1, wherein the straight regions of the outer contour line 7 are connected by rounded corners.

Furthermore, the contact region 8 has two holes 9, which are separated from one another by a web-shaped region 11 of the metal sheet.

The holes 9 each have a contour line 10 running largely straight along the web-shaped region 11 and running in rounded fashion beyond the web-shaped region 11, such that the cutouts 9 are circle-segment-shaped or semicircular. A circle segment is a partial area of a circle area which is delimited by a circle arc and a circle chord.

It should be noted that exemplary embodiments (not illustrated) comprising only one hole, for example round or oval, are also conceivable.

Figure 2:
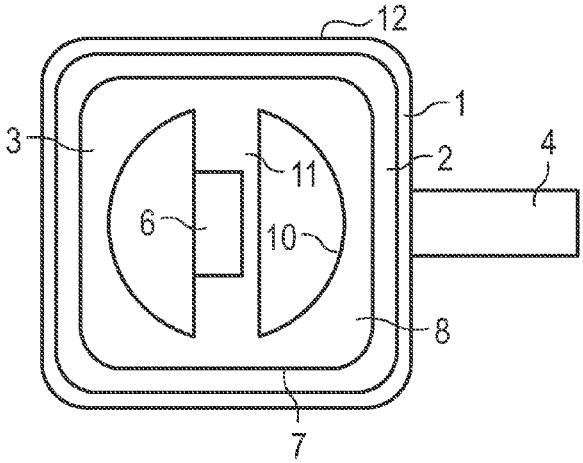
FIG. 2 shows the rear side of an exemplary embodiment of a component.

FIG. 2 shows the rear side of an exemplary embodiment of a component comprising a contact-connection element 3 whose form corresponds to that of the contact region 8. The outer contour line 7 of the contact region 8 has straight regions running along straight regions of the side edge 12 of the component body 1, wherein the straight regions of the outer contour line 7 are connected by rounded corners. Furthermore, the contact region 8 has two circle-segment-shaped cutouts 9 separated from one another by a sheet-metal web-shaped region 11. At one side of the web-shaped region 11 there is a rectangular sheet-metal region which serves as a further contact-connection region 6 and is bent over in such a way that it lies on the web-shaped region 11. Alternatively, it can be bent over such that it lies below the web-shaped region 11. The double sheet-metal layer of web-shaped region 11 and further contact-connection region 6 gives rise to an elevated region for further contact-connection on the rear side of the component. The further contact-connection region 6 can be, for example, 4.5 mm wide and 9 mm long. With regard to its width, the region can be offset from the center by 1.5 mm, for example. The elevated region for further contact-connection with double sheet-metal thickness, as well as the further contact-connection 4, can be optimised and dimensioned with regard to different requirements, for example customer specifications. In this exemplary embodiment, the width of the further contact-connection region 6 is less than the width of the web-shaped region 11.

In contrast to the exemplary embodiments mentioned above, previously known contact regions (not illustrated), which are ring-shaped, for example, do not extend into the corner regions of the front or rear side of the component body, which is associated with a poor current supply of the relatively large corner region by the relatively short circle segment provided therefor. Corners in the outer contour line of previous contact regions (not illustrated) lead to a current increase that opposes the desired uniform current transition of external contact-connection and metal layer. This effect also occurs when bending up the end of a sheet-metal portion projecting into the hole at its corners.

The above-mentioned disadvantages are overcome by the exemplary embodiments of a rectangular contact region 8 with rounded corners. Advantages are afforded since the outer contour line 7 is drawn outwards in comparison with round contact regions and its shaping is thus adapted to the form of the metal layer 2. In order that the copper layer of the contact region 8 is not made excessively solid or material-intensive, at least one hole 9 is provided in the inner region of the contact region 8. By varying the diameter thereof, it is possible to adapt the material outlay for the contact-connection element 3. A circular basic form of the hole, or of an arrangement of holes with one or a plurality of web-shaped regions 11, enables an optimized current distribution. Given a relatively large internal diameter of the holes, the web-shaped region 11 serves to additionally supply the inner region.

The rounded corners of the outer contour line 7 prevent current spikes. This aim is also achieved by integrating the double metal sheet into the continuous web-shaped region 11, such that corners are avoided here as well.

Figure 3:
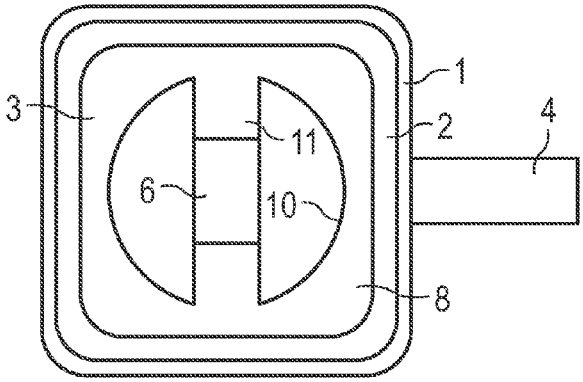
FIG. 3 shows the rear side of an exemplary embodiment of a component.
Figure 4:
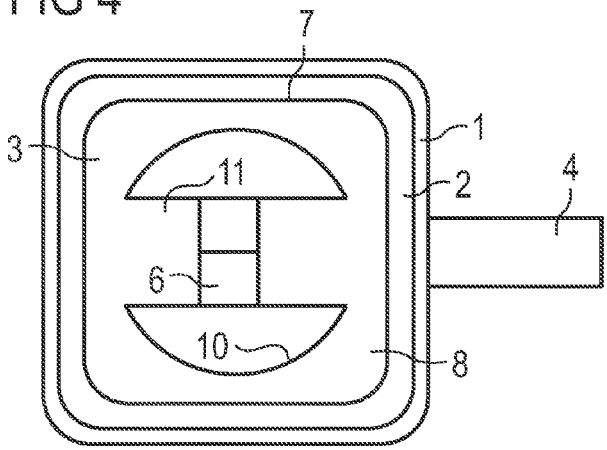
FIG. 4 shows the rear side of an exemplary embodiment of a component.

FIGS. 3 and 4 show the rear sides of further exemplary embodiments of components in which the further contact-connection is formed by a further contact-connection region 6 with web width, see FIG. 3, or by two sheet-metal regions 6 with half web width which are folded from opposite sides of the web-shaped region 11 onto the latter, see FIG. 4.

The exemplary embodiments in FIGS. 2 to 4 furthermore show that the width of the web-shaped region 11 can vary. FIG. 3 shows that the holes 9 need not be symmetrical, but rather can be shaped as circle segment portions of different sizes, for example having the same radius.

Figure 5:
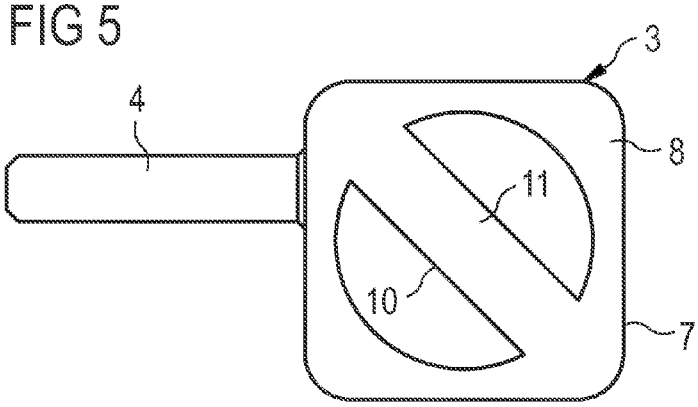
FIG. 5 shows an exemplary embodiment of a contact-connection element.

FIG. 5 shows an exemplary embodiment of a contact-connection element 3 for the front side of a component body 1, which differs from the exemplary embodiment in FIG. 1 in that the orientation of the web-shaped region 11, in comparison with the orientation of the further contact-connection 4, is not effected in a parallel fashion, but rather angularly, in this case at an angle of 45 degrees or an angle of 135 degrees.

Figure 6A:
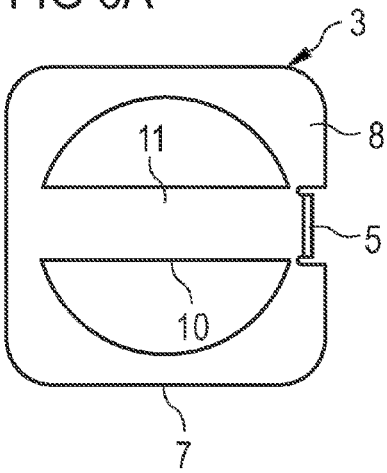
FIGS. 6A and 6B show a further exemplary embodiment of a contact-connection element.
Figure 6B:
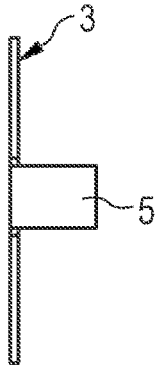

FIG. 6A shows a plan view and FIG. 6B a side view of an exemplary embodiment of a contact-connection element 3 whose further contact-connection 5 abuts the outer side of the contact region 8 and is bent over at a right angle, such that the further contact-connection 5 is positioned at the side of the component body 1.

The contact region 8 is advantageously dimensioned such that the maximum current loading in the inner and outer regions is approximately identical.

The following design rules can be employed for the shaping of the contact-connection element:

$$\frac{a}{R_m} \leq 0.6$$

$$\frac{2}{3}a \leq R \leq R_m$$

$$5 \leq \frac{d}{a} \leq 20$$

wherein the variables can be seen in FIG. 1 and have the following meanings:

a: distance between contact region metal sheet and edge of the metal layer $R_m$: corner radius of the metal layer R: corner radius of the contract region metal sheet d: diameter of the inner hole in the contact region metal sheet s: web width b: total width of the contact region, i.e., width of the metal layer minus double the distance a.

The width of the web-shaped region s results from the stipulations for the further contact-connection region 6 with double sheet-metal thickness. FIGS. 3 and 4 show possibilities for orienting the web-shaped region 11. The symmetry was re-established in FIG. 2 in contrast to FIG. 3. For the front side, the web width was chosen to be identical to that of FIG. 2.

In the case of a block-shaped component having the exemplary dimensions 33×33×3 mm, the following exemplary dimension result:

a: 2.0 mm $R_m$: 4.0 mm

R: 4.0 mm d: 21.0 mm s: 6.0 mm (FIGS. 1 and 2) 4.5 mm (+1.5 mm offset in FIG. 3); 9.0 mm (in FIG. 4)

b: 26.0 mm

It should be noted that features of the exemplary embodiments can be combined. Furthermore, the exemplary embodiments of the contact-connection elements 3 shown for the front side can also be combined with those for the rear side in one component, such that the orientation of the web-shaped regions 11 on the front and rear sides of the component can be effected in a parallel manner, at right angles or at an arbitrary angle with respect to one another or with respect to the orientation of the further contact-connection 4.

What is claimed is:

1. A component comprising:

a component body; and a contact-connection element composed of sheet metal comprising a contact region, which has an outer contour line and at least one hole, wherein the contact region is arranged on a side of the component body comprising a side edge and the outer contour line has straight regions running along straight regions of the side edge, wherein the straight regions of the outer contour line are connected by rounded corners and wherein the at least one hole comprises two holes separated from one another by a web-shaped region.

2. The component according to claim 1, wherein the outer contour line is spaced apart from the side edge.

3. The component according to claim 1, wherein the outer contour line is rectangular with rounded corners.

4. The component according to claim 3, wherein the side edge is rectangular with rounded corners.

5. The component according to claim 1, wherein the hole has a round or oval shape.

6. The component according to claim 1, wherein the holes each have a contour line running largely straight along the web-shaped region.

7. The component according to claim 1, wherein the holes each have a contour line running in rounded fashion beyond the web-shaped region.

8. The component according to claim 1, wherein the holes are circle-segment-shaped.

9. The component according to claim 1, further comprising a further contact-connection region that is bent over such that the further contact-connection region is positioned on or below the web-shaped region.

10. The component according to claim 1, wherein the contact-connection element comprises a further contact-connection that is positioned in a manner bent angularly with respect to the contact region at an edge side of the component body.

11. The component according to claim 1, wherein the contact-connection element comprises a web-shaped further contact-connection extending away from the component body.

12. The component according to claim 1, wherein the contact-connection element is produced from a copper metal sheet.

13. The component according to claim 1, wherein the contact region is arranged on a metal layer on the component body.

14. The component according to claim 1, wherein the component body is a varistor.

* * * * *

UNITED STATES PATENT AND TRADEMARK OFFICE

CERTIFICATE OF CORRECTION

PATENT NO. : 8,610,534 B2
APPLICATION NO. : 13/690050
DATED : December 17, 2013
INVENTOR(S) : Franz Rinner It is certified that error appears in the above-identified patent and that said Letters Patent is hereby corrected as shown below:

On the Title Page, Item (72) Inventors, line 4, delete "Zhihai" and insert --Zhuhai--.

Signed and Sealed this
Fourth Day of March, 2014

Michelle K. Lee

Michelle K. Lee
*Deputy Director of the United States Patent and Trademark Office*